US006767164B2

(12) United States Patent
Shimizu et al.

(10) Patent No.: US 6,767,164 B2
(45) Date of Patent: Jul. 27, 2004

(54) TUNNEL WATERPROOFING CONSTRUCTION METHOD

(75) Inventors: Sachio Shimizu, Tokyo (JP); Keiichi Kosuge, Tokyo (JP)

(73) Assignee: W. R. Grace & Co.-Conn., Columbia, MD (US)

( * ) Notice: Subject to any disclaimer, the term of this patent is extended or adjusted under 35 U.S.C. 154(b) by 0 days.

(21) Appl. No.: 10/297,370

(22) PCT Filed: Jun. 5, 2001

(86) PCT No.: PCT/US01/18174

§ 371 (c)(1),
(2), (4) Date: Dec. 5, 2002

(87) PCT Pub. No.: WO01/96710

PCT Pub. Date: Dec. 20, 2001

(65) Prior Publication Data

US 2003/0133756 A1 Jul. 17, 2003

(30) Foreign Application Priority Data

Jun. 12, 2000 (JP) ..... 2000-175768

(51) Int. Cl.[7] ..... E21D 11/38
(52) U.S. Cl. ..... 405/150.2; 405/150.1
(58) Field of Search ..... 405/132, 150.1–150.3

(56) References Cited

U.S. PATENT DOCUMENTS

| | | | | |
|---|---|---|---|---|
| 3,545,213 A | | 12/1970 | Sebor et al. | 61/45 |
| 4,247,221 A | | 1/1981 | Lewer et al. | 405/150 |
| 4,695,188 A | | 9/1987 | Pulkkinen | 405/150 |
| 4,915,542 A | | 4/1990 | Fernando | 405/150 |
| 5,763,014 A | | 6/1998 | Pickett | 427/430.1 |
| 5,934,828 A | * | 8/1999 | Hu et al. | 405/43 |
| 5,993,114 A | | 11/1999 | Jones | 405/150 |
| 6,193,439 B1 | | 2/2001 | Wolfseher | 405/150.2 |
| 6,403,686 B1 | | 6/2002 | Pickett et al. | 524/310 |
| 6,460,859 B1 | * | 10/2002 | Hammi et al. | 277/596 |

FOREIGN PATENT DOCUMENTS

| | | | |
|---|---|---|---|
| DE | 2112046 A | 11/1982 | E21D/11/38 |
| EP | 0 898 052 A1 | 2/1993 | E21D/11/38 |
| EP | 0 898 052 A1 | 2/1999 | E21D/11/38 |
| JP | 62 28478 | 2/1987 | D06N/3/00 |
| JP | 3-137182 | 6/1991 | C09K/3/10 |
| JP | 06 055481 | 3/1995 | E21D/121/10 |
| WO | WO 87/04756 | 8/1987 | |
| WO | WO 97/25484 | 7/1997 | E02D/1/00 |
| WO | WO 98/24738 | 6/1998 | C04B/41/71 |
| WO | WO 00/05487 | 3/2000 | E21F/16/02 |

OTHER PUBLICATIONS

JP 3–137182 Abstract of Japan (1991).
*Waterproofing Between Slab Floors*, LBI Technologies, Inc., (1995).
*Tunnel Opportunity*, Daily Mail.
*Strata Support Waterproofing*, DiNoia, Grace Performance Chemicals (2001).

* cited by examiner

*Primary Examiner*—Robert E. Pezzuto
*Assistant Examiner*—Tara L. Mayo
(74) *Attorney, Agent, or Firm*—Craig K. Leon; William L. Baker

(57) ABSTRACT

A tunnel waterproofing construction method that avoids dripping and fogging during spray application, organic solvents, unpleasant odors, and cracking, while providing workability, superior tunnel waterproofing characteristics, and economic advantage. A primary spray cement concrete is sprayed onto the excavated tunnel surface, and an ambient-temperature vulcanization-type rubber emulsion is sprayed onto the primary concrete, thereby forming a rubber film, and a secondary concrete coating is then established on the rubber surface. The primary spray cement concrete may be used to even out the irregular earthen excavation surface, and a drainage layer may be used along with the primary spray cement concrete surface.

15 Claims, No Drawings

TUNNEL WATERPROOFING CONSTRUCTION METHOD

FIELD OF THE INVENTION

This invention relates to a waterproofing construction and method for tunnels, and more particularly to the constructions and use of a vulcanization-type rubber film on a tunnel waterproofing surface.

BACKGROUND OF THE INVENTION

In this invention, paste, mortar, and concrete are used as general terms to refer to cement concrete.

The principle tunnel construction method in Japan currently is the New Austrian Tunneling Method (NATM method). In the NATM construction method, a primary coating is applied by means of spraying mortar or concrete immediately after excavation of the tunnel to prevent falling rock and water leakage in the excavation region. After this, a secondary coating of concrete is applied to stabilizing the tunnel by maintaining tunnel strength. At this time, a waterproofing sheet is installed for the waterproofing purposes, and insulation between the primary coating concrete and the secondary coating concrete, so that leakage of water into the tunnel can be prevented, and so that cracks due to binding of the secondary concrete coating to earth mounds, which might move, can be prevented. Most recently, tunnel excavation has been performed by tunnel boring machines (TBM construction method), and waterproofing sheets are installed for the same objectives.

Installation of this waterproofing sheet involves installation on the primary coating concrete surface by human hands. In particular, there is the problem that it is an operation that is performed on a stand at the ceiling of the tunnel, such that it is dangerous, and there are limitations on movement during the installation operations. In addition, there is the problem that the application surface is the excavation surface, which is uneven, making application after the primary coating difficult to accomplish. Further, because the width of the sheet is narrow (e.g., one to two meters), it is necessary to superimpose numerous waterproofing sheets. The overlapping of the waterproofing sheets requires great effort and is sometimes uneconomical.

There is the further problem that water infiltrates between the waterproofing sheet and the secondary concrete coating due to damage of the sheet by poorly welded components. Also, the irregularities in the excavated surface of the tunnel often defeats the waterproofing capacity of the sheet.

In order to solve these problems, methods for performing waterproofing by spraying an aqueous solution of a polymerizable monomer and forming a waterproofing film was disclosed in Japanese Patent Application (Early Disclosure) No. 61-19683 (1986) and Japanese Patent Application (Early Disclosure) No. 3-137182(1991).

However, there are still problems in that moist surfaces cause poor adhesion, and the film becomes non-uniform due to dripping after spraying. Also, the spraying is foggy, which deteriorates the working environment, and the price is high, making the application uneconomical.

The present inventors conducted various studies of the aforementioned problems. As a result, they discovered a novel tunnel waterproofing construction method in which a rubber emulsion vulcanizable at ambient temperatures is applied by blowing it and forming a film without seams. The film has excellent physical properties and waterproofing capacity, and the method is extremely economical because it avoids dripping and fogging during spray application. It has fewer organic volatile components in comparison with urethane-based compositions; it has no unpleasant odors; and it has excellent workability and waterproofing properties inside the tunnel. Cracks do not develop in the secondary cement concrete coating.

SUMMARY OF THE INVENTION

The present invention, specifically, provides a tunnel waterproofing construction method, wherein a primary spray cement concrete coating is spray applied onto a tunnel excavation surface, a rubber emulsion operative to vulcanize at ambient temperature is spray-applied onto the primary spray cement concrete coating, thereby forming a rubber film thereon, and a secondary cement concrete coating is applied onto the rubber film surface.

More particularly, the tunnel excavation surface is made "nonlanded" by the primary spray cement concrete coating (in other words, the irregularities of the excavated earth surface are evened out) so that the ambient-temperature vulcanizable emulsion can be spray-applied onto the primary spray cement concrete and thereafter a secondary cement coating can be established thereon.

In further exemplary embodiments, a buffer-water conductive layer is installed on the primary spray cement concrete coating, and the ambient-temperature vulcanizable emulsion is thereafter applied thereon to form a rubber film, whereupon the secondary cement concrete coating may subsequently be established on the rubber film.

DETAILED DESCRIPTION OF EMBODIMENTS OF THE INVENTION

Exemplary embodiments of the present invention may now be described in further detail.

This invention is a construction method in which a film without seams and having good physical properties is formed, preferably by spray-applying a primary spray cement concrete on an excavated tunnel surface, after which an ambient-temperature vulcanization-type rubber emulsion is sprayed and a vulcanization reaction is obtained at ambient temperature. From the standpoints of facilitating attachment of the primary spray cement concrete and achieving good workability, the ambient-temperature vulcanization-type rubber emulsion should comprise a substance that contains the rubber emulsion (hereafter referred to as agent A) and an oil-extended oil in which the vulcanization agent is dispersed (hereafter referred to as agent B). Agent A and agent B are sprayed while being mixed at the nozzle tip (used for spraying A and B).

The rubber emulsion that is used in agent A can be a synthetic rubber, such as styrene butadiene rubber, chloroprene rubber, or isoprene rubber, as well as natural rubber. In addition, blends of these rubbers may be used. Of these substances, styrene butadiene rubber is desirable from the standpoints of vulcanization physical properties and economic factors, and chloroprene is desirable from the standpoint of increased flame-retarding properties.

From the standpoint of obtaining a good film, the solid component of the rubber emulsion should be 15 to 40 parts by mass, and preferably 20–30 parts by mass, in 100 parts of total solid components after blending agent A and agent B.

From the standpoint of the stability of the rubber emulsion, a strong alkali such as potassium hydroxide, KOH, or sodium hydroxide, NaOH, may be used as a pH regulator in an amount ordinarily of 1.5 parts by mass, and, at a maximum of 2.5 parts by mass, per 100 parts by mass of rubber solid components.

From the standpoint of facilitating regulation of the physical properties of the rubber after vulcanization, an oil in which an aromatic oil and paraffin oil are mixed is desirable as the oil-extended oil used for agent B. Paraffin oil is used at a ratio of less than 50 parts by mass per 100 parts by mass of rubber solid components for the purpose of adjusting viscosity when it is blended with agent A. Chlorinated paraffin can also be used for the purpose of increasing flame-retarding properties. Asphalt can also be used in agent B. The ratio should be less than 30 parts by mass per 100 parts by mass of rubber solid components.

The vulcanization agent that is dispersed in the oil-extended oil used in agent B may be a sulfur vulcanization agent, with sulfur being preferred. The quantity of vulcanization agent should be 0.5 to 20 parts by mass per 100 parts by mass of rubber solid components.

A vulcanization accelerator may be used in combination with agent B. Examples of vulcanization accelerators can include zinc isopropyl xanthate, zinc dibutyldithiocarbamate dibutylamine complex and zinc oxide. The quantity of vulcanization accelerator used should be 0.1 to 5.0 parts by mass per 100 parts by mass of rubber solid components when zinc isopropyl xanthate is used, 0.1 to 5.0 parts by mass per 100 parts by mass of rubber solid components when zinc dibutyldithiocarbamate dibutylamine complex is used, and 0.5 to 20.0 parts by mass per 100 parts by mass of rubber solid components when zinc oxide is used.

In addition, additives such as fumed silica, polymer fibers, and powdered rubber may be used in agent B in amounts of 0.5 to 25 parts by mass per 100 parts by mass of the total solid components.

In addition, various types of inorganic substances (metal oxides such as calcium oxide, Portland cement, high alumina cement and calcium sulfate) and various types of coloring agent can also be used in agent B.

The tunnel waterproofing construction method may be a construction method based on the NATM construction method of the TBM construction method, in which a rubber emulsion operative to vulcanize at ambient temperature is spray applied onto an excavated tunnel surface after a primary spray cement concrete is sprayed thereon, or after a buffer-water conductive layer (i.e. drainage) is established on the primary spray-applied cement concrete, with vulcanization and hardening being effected at ambient temperature.

Moreover, smoothing out the irregularities of the excavation surface (i.e., by "nonlanded" regulation) by spray-applying the primary spray cement concrete on the tunnel excavation surface (from an economic standpoint, it is desirable to effect "nonlanded" regulation by further spraying of a general primary spray cement concrete after ordinary spraying of a fast-drying spray cement concrete), or by applying a buffer-water conducting layer to the primary spray cement concrete surface after spraying a primary spray cement concrete on the tunnel excavation surface and then further spraying a rubber emulsion operative to vulcanize at ambient temperature is desirable from the standpoints of further increasing the insulation effect and making it difficult for cracking to occur in the secondary coating cement structure. Further, better results are obtained when these measured are used in combination.

The establishment of a buffer-water conductive layer (drainage) has the particular advantage that makes it possible to form a film when the ambient temperature vulcanizable emulsion is formed, even when there is some water leakage from the primary spray cement concrete.

Examples of buffer-water conductive layers include layers formed by spraying fibrous substances such as moistened pulp and layers in which nonwoven fabrics such as long polyester fibers and polypropylene, or in which irregularly shaped plates are affixed.

Although there are no particular limitations on the method for affixing nonwoven fabrics or irregularly shaped plates to the primary spray cement concrete surface, adhesive agents and rivets may be used.

The spraying machine that is used in the waterproofing construction method of this invention is a type whereby agent A and agent B are introduced under pressure by separate pumps, with their ratios being regulated, and they are mixed at the nozzle component or before the nozzle, after which the mixture is sprayed at ordinary air pressure. However, an airless spraying machine may be used, or an air application machine may be used.

By spraying and applying the ambient-temperature-hardening rubber emulsion to a thickness on the order of 1 to 3 mm. (which emulsion may also be more thickly sprayed), a film without seams and of good physical properties is formed at normal temperature.

After the film has been formed in this way, a secondary coating cement concrete is applied and construction is completed.

The invention may be illustrated by the following examples.

EXAMPLE 1

A U-shaped simulation tunnel having openings of 4 m, a height of 3.5 m, and a length of 3 m was made. Irregularities of the tunnel earth mound surface were presumed in the simulation tunnel, and fifteen concrete blocks of 15 cm in width, 20 cm in height, and 20 cm in length were installed at suitable intervals to form an irregular surface.

Fast-drying mortar was sprayed as the primary spray mortar and "nonlanded" adjustment of the irregular surface was effected (i.e., the sprayed surface irregularities were evened out).

Immediately after spraying, a two-agent rubber emulsion operative to vulcanize at ambient temperature (available from Grace Construction Products, United States, under the brand name PROCOR 75), comprised of agent A of which styrene butadiene rubber was the principle component, and agent B which contained calcium oxide, sulfur, aromatic oil, paraffin oil, zinc oxide, clay and calcium carbonate, was applied by spraying on the mortar surface to a thickness of 2 mm by an air spraying machine after mixing agent A and agent B at the nozzle component. One day after spraying, secondary coating concrete was applied to a thickness of 30 cm.

As a result, the following points were found.

1. There was a good film application capacity using the spray operations, and it was possible for two operators to apply film in an amount of more than 100 $m^2$/hour.
2. There was no generation of fog during spraying, no dripping from roof surfaces, no unpleasant odor, and a spraying of uniform thickness could be performed.
3. A uniform, good film with no cracks or pinholes could be obtained. In addition, no differences were observed in the thickness of the film immediately after application and after hardening.

4. Checks were made by visual observation for the occurrence of cracks after removal of secondary coating cement concrete from the mold frame and three months thereafter. As a result, cracks were not found.
5. The properties of the film formed by spray application are indicated below. A good ambient-temperature vulcanization type rubber film was obtained. Film strength: 0.82 ($N/mm^2$ (ambient temperature); 1.1 N/mm2 (−30° C.). Elongation: 700% (ambient temperature); greater than 800% (30° C.). Recovery after 100% elongation: 95%. Tearing strength: 4.55 $N/mm^2$ Resistance to static water pressure: 30 m.

The test methods for the various physical properties were as follows.

Film strength, elongation and recovery were tested in accordance with ASTM D 412-92.

Tearing strength was tested in accordance with ASTM D 642-86.

Resistance to static water pressure was tested in accordance with ASTM D 5385-93 (Determination in cases in which ambient-temperature vulcanization type rubber emulsions are sprayed onto concrete surfaces).

EXAMPLE 2

A U-shaped simulation tunnel having openings of 4 m, a height of 3.5 m, and a length of 3 m was made. Irregularities of the tunnel earth-mound surface were presumed in the simulation tunnel, and fifteen concrete blocks of 15 cm in width, 20 cm in height, and 20 cm in length were installed at suitable intervals to form an irregular surface.

Fast-drying mortar was sprayed as the primary spray mortar, and "nonlanded" adjustment of the irregular surface was effected (i.e. uneven spraying on tunnel wall was evened out).

Immediately after spraying, a nonwoven fabric made of polyester fibers was affixed by rivets to the primary spray mortar surface.

A two-agent, ambient-temperature vulcanization-type rubber emulsion (PROCOR 75 brand from Grace Construction Products, United States) was applied to the surface of the nonwoven fabric and was applied by spraying to the mortar surface by an air spraying machine so that the thickness was 2 mm after mixing agent A and agent B at the nozzle component, with a film being formed. One day after spraying, secondary coating concrete was applied to a thickness of 30 cm.

As a result, the following points were found.

1. There was a good film application capacity using the spraying operations, and it was possible for two operators to apply film in an amount of more than 100 $m^2$/hour.
2. There was no dripping from roof surfaces, no unpleasant odor, and spraying of a uniform thickness could be performed.
3. A uniform, good film with no cracks or pinholes could be obtained. In addition, no differences were observed in the thickness of the film immediately after application and after hardening.
4. Checks were made by visual observation for the occurrence of cracks after removal of secondary coating cement concrete from the mold frame and three months thereafter. As a result, no cracks were found.

EXAMPLE 3

A U-shaped simulation tunnel having openings of 4 m, a height of 3.5 m, and a length of 3 m was made. Irregularities of the tunnel earth mound surface were presumed in the simulation tunnel, and fifteen concrete blocks of 15 cm in width, 20 cm in height, and 20 cm in length were installed at suitable intervals to form an irregular surface.

Fast-drying mortar was sprayed as the primary spray mortar without making "nonlanded" adjustment of the irregular surface. Immediately after spraying, a two-agent, ambient-temperature-type rubber emulsion (manufactured by Grace Construction Products, United States, under the brand name PROCOR 75) was applied by spraying to the mortar surface by an air spraying machine so that the thickness was 2 mm after mixing agent A and agent B at the nozzle component, with a film being formed. One day after spraying, secondary coating concrete was applied to a thickness of 30 cm.

As a result, the following points were found.

1. There was a good film application capacity using the spraying operations, and it was possible for two operators to apply film in an amount of more than 100 $m^2$/hour.
2. Checks were made by visual observation for the occurrence of cracks after removal of secondary coating cement concrete from the mold frame and three months thereafter. As a result, it was found that one crack had developed in the secondary coating concrete surface. However, when the core in that region was removed and checked, there were no abnormalities in the film and water leakage was not seen.

Comparative Example 1

The same procedure was carried out as in Example 3 except that mixtures comprised of aqueous acrylate and methacrylate solutions and of redox catalyst systems were used instead of two-agent, ambient temperature type rubber emulsion (brand name PROCOR 75, manufactured by Grace Construction Products, USA).

As a result, the following points were found.

1. There was marked fogging due to spraying, and the working environment was poor. In addition, icicle-like dripping occurred on the sprayed surface, and operating characteristics were poor.
2. Checks were made by visual observations for occurrence of cracks after removal of the secondary coating concrete from the mold frame and three months thereafter. As a result, it was found that two cracks had developed in the secondary coating concrete surface.

The following results (and capabilities) were achieved by the tunnel waterproofing construction method using the ambient-temperature vulcanization type emulsion of this invention.

1. The ambient-temperature vulcanization-type emulsion is not toxic. Because the water component in this emulsion does not separate, water infiltration into the working environment does not occur. The ambient-temperature vulcanization-type emulsion does not cause fogging that can occur during spraying. For these reasons, workability can be greatly improved, safety during operations can be improved, and the environment can be protected.
2. By effecting vulcanization at ambient-temperature, a film having good physical properties and not having seams can be formed.
3. A film having superior waterproofing properties can be applied in stable fashion.
4. Because organic solvents are not used, there is little possibility of the occurrence of fire or intoxication during operations and toxic gases are not generated during such fires.

5. The tunnel waterproofing construction method of this invention exhibits good application characteristics and wide application can be made to a large surface by a small number of workers. Therefore, overall costs can be reduced.

6. Cracking of the secondary coating cement concrete can be further decreased as a result of the facts that: (1) the primary spray cement concrete surface is subjected to "nonlanded" regulation, (2) a buffer material-water conductive layer is established, and (3) that both treatments (1) and (2) are performed.

It is claimed:

1. A tunnel waterproofing construction method, comprising:

spray-applying cement concrete onto a tunnel excavation surface to provide a primary cement concrete lining within said tunnel excavation;

installing a drainage layer on said primary sprayed cement concrete lining;

forming a rubber film layer on said drainage layer by co-spraying through a nozzle an agent A and an agent B which, when co-sprayed through a nozzle, become mixed, said agent A comprising a rubber emulsion operative to vulcanize at ambient temperature to form a rubber film and said agent B comprising an oil in which a vulcanization agent is dispersed, whereby said rubber emulsion and vulcanization agent are mixed during spraying and said rubber emulsion thereby forms a rubber film layer; and coating a secondary cement concrete onto said rubber film layer formed on said drainage layer.

2. A tunnel waterproofing construction made by the method of claim 1.

3. The method of claim 1 wherein said rubber emulsion comprises a synthetic rubber selected from the group consisting of styrene butadiene rubber, chloroprene rubber, and isoprene rubber.

4. The method of claim 1 wherein said rubber is natural rubber.

5. The method of claim 1 wherein said rubber emulsion has a solids component that is not less than 15 parts by mass and not greater than 40 parts by mass, said mass being based on 100 parts of total solids components after blending said agent A and said agent B.

6. The method of claim 5 wherein said rubber emulsion has an alkali component in an amount not less than 1.5 parts and not greater than 2.5 parts by mass per 100 parts by mass of solids in said rubber emulsion.

7. The method of claim 1 wherein said agent B contains aromatic oil and paraffin oil.

8. The method of claim 1 wherein said vulcanization agent is sulfur.

9. The method of claim 8 wherein said sulfur vulcanization is used in an amount not less than 0.5 parts and not greater than 20 parts by mass per 100 parts by mass of rubber solids in said agent B.

10. The method of claim 1 wherein said agent B further comprises a vulcanization accelerator.

11. The method of claim 1 wherein said agent B further contains an additive selected from the group consisting of fumed silica, polymer fibers, and powdered rubber.

12. The method of claim 1 wherein said agent B further contains an inorganic substance selected from the group consisting of a metal oxide, Portland cement, high alumina cement, calcium sulfate, and coloring agent.

13. The method of claim 1 wherein said drainage layer comprises nonwoven fabric or irregularly shaped plates.

14. The method of claim 1 wherein said drainage layer is formed by spraying fibrous substances selected from the group consisting of pulp and fibers.

15. A tunnel waterproofing construction method, comprising:

spray-applying a primary spray cement concrete onto a tunnel excavation surface;

applying a drainage layer against said spray-applied primary spray cement concrete, said drainage layer comprising a non-woven fabric, irregularly shaped plates, or combination thereof;

forming a waterproofing layer against said drainage layer by spraying together an agent A and an agent B which, when co-sprayed through a nozzle, become mixed, said agent A comprising a rubber emulsion operative to vulcanize at ambient temperature to form a rubber film and said agent B comprising an oil in which a vulcanization agent is dispersed, whereby said rubber emulsion and vulcanization agent are mixed during spraying and said rubber emulsion thereby forms a rubber film layer adjacent or against said primary spray cement concrete; and coating a secondary cement concrete onto the rubber film formed by spraying together said agent A and said agent B.

* * * * *